United States Patent [19]

Moench

[11] 3,989,401

[45] Nov. 2, 1976

[54] SURFACE TREATING APPARATUS

[76] Inventor: Frank F. Moench, P.O. Box 6484, Station B, Albuquerque, N. Mex. 87107

[22] Filed: Apr. 17, 1975

[21] Appl. No.: 568,940

[52] U.S. Cl. ..... 404/95; 404/90

[51] Int. Cl.[2] ..... E01C 23/14

[58] Field of Search ..... 404/90, 95, 77, 117, 404/118, 34, 35, 36, 37, 40, 41

[56] References Cited

UNITED STATES PATENTS

| | | | |
|---|---|---|---|
| 448,658 | 3/1891 | Lynch | 404/38 |
| 796,813 | 8/1905 | Collyer | 404/90 |
| 1,586,325 | 5/1926 | Older | 404/118 |
| 1,929,799 | 10/1933 | Weeks | 404/90 X |
| 1,952,452 | 3/1934 | Monroe | 404/95 |
| 1,984,849 | 12/1934 | Van Allen | 404/95 X |
| 2,053,709 | 9/1936 | Flynn | 404/90 X |
| 2,254,463 | 9/1941 | Wells | 404/95 |
| 3,055,280 | 9/1962 | Neville | 404/95 |
| 3,221,617 | 12/1965 | Qugg | 404/95 |
| 3,361,042 | 1/1968 | Cutler | 404/95 X |

*Primary Examiner*—Nile C. Byers
*Attorney, Agent, or Firm*—Ancel W. Lewis, Jr.

[57] ABSTRACT

In surfacing apparatus for asphaltic surfaces and the like, there is provided a truck-drawn trailer, a hood and burner assembly having a hood suspended from the trailer open at the bottom that heats the surface over which the assembly is moved, a scarifying assembly supported by the trailer that breaks up the heated surface and a leveling device drawn behind the scarifying assembly that levels the broken surface material. The hood and burner assembly has a refractory lined combustion chamber with a sloping roof so that the combustion chamber decreases in volume toward the trailing end for heating uniformly, a joint gap between liner members that is wider at the top and top filled to retain a gap filler material, side sections that swing up to reduce the width for transport, side extension sections that optionally may be added for greater surface widths and separate controls for different banks of burners for independent heat control of different sections of the hood. The scarifying assembly has alternating larger and smaller groups of scarifying elements arranged at spaced intervals across the apparatus with each group being independently resiliently urged into contact with the surface to adjust for surface irregularities. The scarifying assembly has side sections that swing up between an upper out of the way position and a lower working position. The leveling device has a channel member with a flat surface-engaging bottom and a curved moldboard front portion and drawing chain sections of adjustable length to level the scarified material.

24 Claims, 14 Drawing Figures

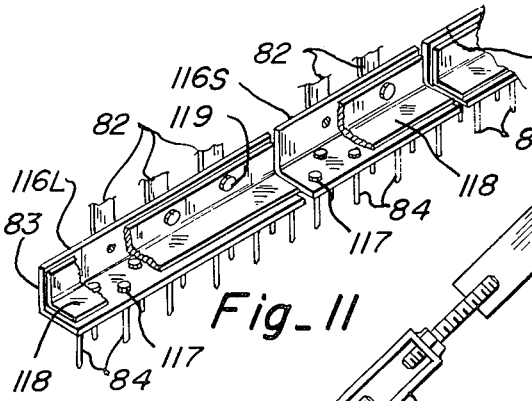
Fig_11
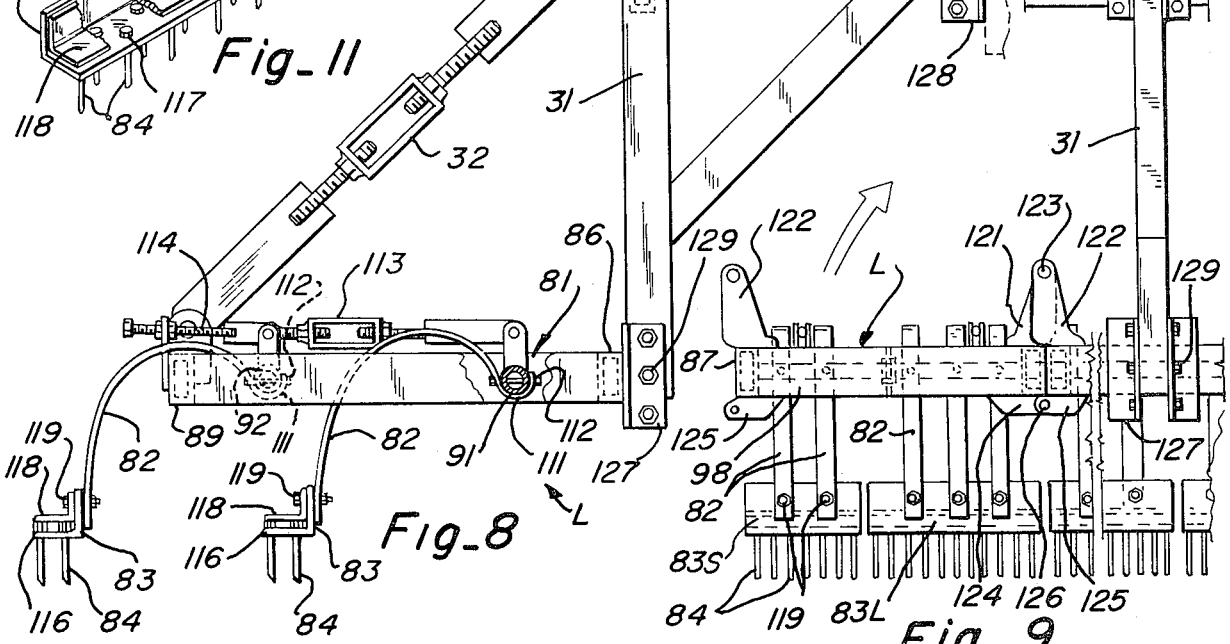
Fig_8
Fig_9
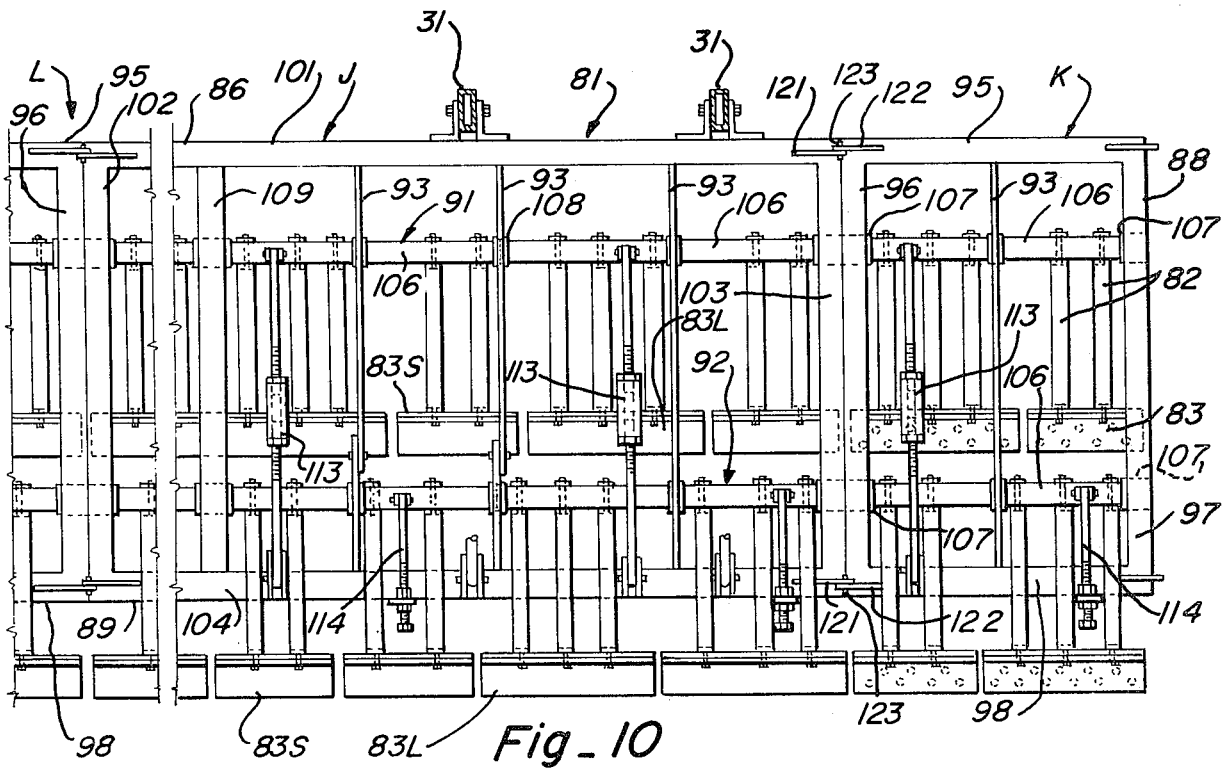
Fig_10

SURFACE TREATING APPARATUS

FIELD

This invention generally relates to surfacing apparatus and more particularly to apparatus for treating asphaltic paving or "black-top" paving surfaces or the like to recondition or renew the same.

BACKGROUND

Asphaltic paving surfaces are in common usage for highways, parking areas and the like. These surfaces frequently require repair due to the formation of holes and irregularities therein. Prior predecessor road-working equipment has been developed to recondition and smooth out these asphaltic surfaces utilizing a heating apparatus that moves over the surface and heats it to a relatively high temperature followed by a scraping breaking up action followed by a smoothing action to recondition and resurface asphaltic surfaces. A distinct advantage of this type of equipment is that the materials are reconditioned and reused. Illustrations of predecessor equipment of this type are described in U.S. Pat. Nos. 3,233,605 and 3,279,458.

Accordingly, it is a general object of this invention to provide improved surface treating apparatus capable of reconditioning and resurfacing asphaltic highway surfaces, asphaltic parking surfaces and the like.

Another object of this invention is to provide novel surface treating apparatus for reconditioning or surfacing asphaltic surfaces in a highly efficient and effective manner which involves the reusing of asphaltic materials.

Still a further object of this invention is to provide an improved surface treating apparatus inclusive of an improved hood and burner assembly characterized by individual brick liners with a joint gap construction that more readily retains a gap filler material during the rough usage thereof.

Another object of this invention is to provide an improved surface treating apparatus inclusive of a heated hood that decreases in volume from the leading end toward the trailing end for heat uniformity of the surface being heated as the hood is moved thereover.

Still another object of this invention is to provide an improved surface treating apparatus in which the hood is made in sections with side sections movable to a raised position to reduce the width during transport and adapted to have sections added on for greater widths.

A further object of the present invention is to provide fuel control for selected banks of burners associated with selected areas of the hood to heat only portions of the hood as required, the fuel control being further characterized by a pilot flow line portion to deliver lesser amounts of fuel to the burners during start up or transport and a main flow line portion to deliver full fuel during normal operations.

Another object of this invention is to provide an improved surface treating apparatus inclusive of a scarifying assembly which breaks up and distributes the asphaltic materials after it has been heated.

Still another object of this invention is to provide an improved surface treating apparatus in which a scarifying assembly has a plurality of scarifying heads of alternating larger and smaller sizes with multiple scarifying elements on each head, each head being independently resiliently urged into engagement to adjust for surface irregularities.

Yet a further object of this invention is to provide an improved surface treating apparatus in which a scarifying assembly is made in sections with a main section and opposed side sections adapted to swing to a raised position to reduce the width during transport or for use of only selected side sections.

Still another object of the present invention is to provide an improved surface apparatus in which a trailing leveling device follows the scarifying assembly to level out the loosened surface material.

Other objects, advantages and capabilities of the present invention will become more apparent as the description proceeds taken in conjunction with the accompanying drawings, in which:

FIG. 8 is a side elevation view of the scarifying assembly shown in FIG. 1;

FIG. 9 is a rear end elevation view of a portion of the scarifying assembly;

FIG. 10 is a top plan view of a portion of the scarifying assembly;

FIG. 11 is a perspective view of a portion of adjacent scarifying heads with portions of the upper angle member broken away;

Figure 1:
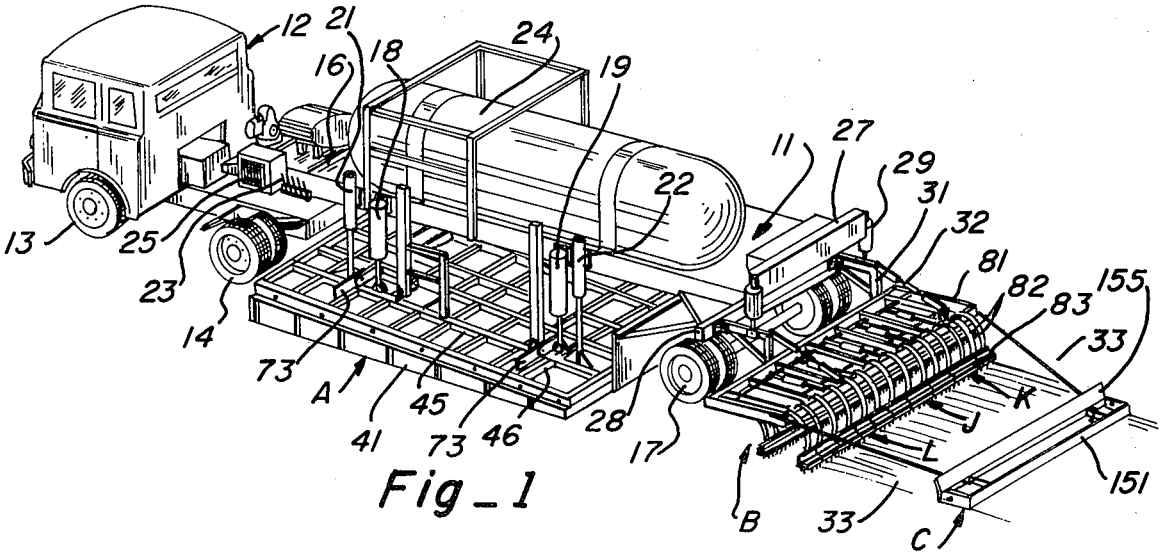
FIG. 1 is a rear perspective view of a truck-drawn trailer supporting surface treating apparatus of the present invention.

Referring now to FIG. 1, there is shown a trailer 11 that is drawn by a truck 12 with front wheels 13 and rear wheels 14 carrying surface treating apparatus constructed in accordance with the present invention. The surface treating apparatus, in general, includes a hood and burner assembly A that heats a surface over which it is moved, a scarifying assembly B that scrapes, breaks up and distributes the heated surface material and a leveling assembly C that levels the scarified surface and material. The surface being worked is usually an asphaltic roadway with holes, waves, undulations and the like which result from normal usage thereof.

The trailer 11 shown has a longitudinally extending frame 16 which is releasably mounted at its front end at the rear platform of the truck 12 with the frame 16 having a set of rear wheels 17. The trailer frame 16 carries a front cylinder 18 and rear cylinder 19 on each side thereof, the cylinders depending from the frame 16 and being of the two-way hydraulic type for supporting and raising and lowering the hood and burner assembly A. Front and rear telescoping supports 21 and 22, respectively, on each side of the frame which also serve to support the hood and burner assembly from the frame 16. Hydraulic control levers 23 are provided for regulating hydraulic cylinders used in this apparatus and they are shown alongside the frame 16 in a convenient, accessible location for the operator. The hood and burner assembly A is shown as located between the rear wheels 14 of the truck and the wheels 17 of the trailer. A fuel tank 24 is mounted on the trailer frame 16 in a central location above the hood and burner assembly A. A control box 25 contains control valves for regulating the fuel from the tank 24 to the burners as described hereinafter with reference to FIG. 12. This control box 25 is shown as located above the rear wheels 14 of the truck on the trailer frame 16.

An upper transverse bar 27 and a lower transverse bar 28 are affixed to the rear end of the trailer frame 16. Inverted L-frames 31 are connected at one end to bar 28 and at the other end to the support frame 18 discussed hereinafter of the scarifying assembly B to support the scarifying assembly B in a depending position rearwardly of the trailer wheels 17. These connections between the frame 28 and frame 31 and between frame 31 and the scarifying frame are vertically adjustable as described in detail hereinafter. Laterally spaced, two-way cylinders 29 are connected to bar 27 and to a central part of inverted laterally spaced L-frames 31 to support the scarifying assembly B and raise and lower the scarifying assembly B as required. An adjustable turnbuckle 32 extends from the top of each frame 31 to the scarifying assembly for added support. Cylinders 29 are manually operated by control levers represented at 23 above described. The leveling assembly C is connected to the scarifying assembly B by a pair of opposed chains 33 of adjustable length so that the leveling assembly C trails the scarifying assembly B.

The hood portion of assembly A, in general, has a top wall portion 37, a front wall portion 38, a rear wall portion 39 and opposed side wall portions, the hood being open at the bottom to form an inner combustion chamber 42 that overhangs an area of the surface being worked. The hood 36 generally is made up of a skeletal, box-like outer support frame and an inner liner that tapers along the roof at the inside from front to rear as represented by line 40. The inside roof 40 of the hood tapers downwardly toward the rear wall portion 39 along the inside or gradually diminishes in height in relation to the trailing end so as to gradually diminish in volume. This results in a less distance from the top of the combustion chamber to the surface being heated and results in a more uniform heating effect on all surfaces being heated by the hood and burner assembly and does not leave any appreciable dead space in the combustion chamber 42.

Figure 2:
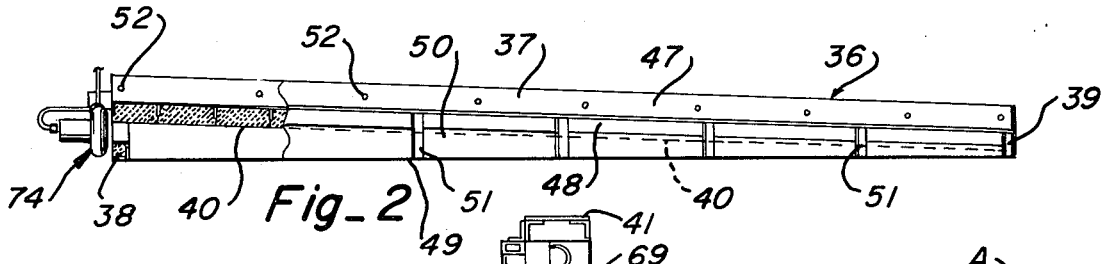
FIG. 2 is a side elevation view of the hood and burner assembly shown in FIG. 1 with a portion broken away to show interior construction.
Figure 7:
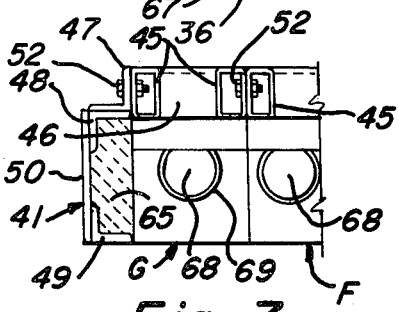
FIG. 7 is an enlarged front end elevation view of the extension section of the hood assembly with the burners removed.

The outer support frame of the hood 36 has a top frame portion comprised of a plurality of laterally spaced, longitudinally extending tubular longitudinal members 45 and a plurality of laterally extending, longitudinally spaced tubular cross members 46 connected at the ends to the sides of the longitudinal members 45. The sides or side wall portions 41 of the hood, as best seen in FIG. 7, each have an outer frame with an upper part formed by a top angle member 47 having an upright leg and an outwardly projecting leg and a lower part in the form of an angle member 48 having an upper inturned leg abutted against the lower leg of member 47 and depending outer leg. A lower angle member 49 is spaced from and opposed to the angle member 48 and has an upright outer leg and an inturned lower leg. A backing plate 50 is connected to the outer legs of angle members 48 and 49 and spaced braces 51 connect outside the plate 50 to members 48 and 49 as best seen in FIG. 2. The top angle member 47 is releasably fastened to the adjacent longitudinal member 45 of either a side section E or F or a side extension section G by means of a plurality of bolt and nut fasteners 52 arranged at spaced intervals along the members 47. In general, the outer frame for the front and rear wall portions 38 and 39 is similar in construction to that of the side wall portions 41.

With regard to the inside lining of the hood which forms the combustion chamber 42, there is provided an inner top liner made up of a plurality of individual liner members 55 of a similar construction. Each top liner member 55 includes a metal backing plate 56 on which there is secured a molded refractory brick portion 57 having a particular shape using J-hooks 58 welded at a flattened end opposite the hooked portion to the backing plate 56 and having the hooked portion extending into the refractory brick portion 57. The backing plate 56 is affixed to the outer support frame as by welding or suitable fastening means.

Figure 4:
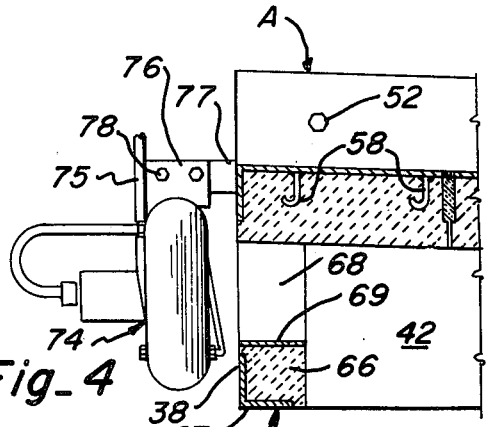
FIG. 4 is an enlarged sectional view taken along lines 4—4 of FIG. 3 showing a forward portion of the inside of the hood assembly.
Figure 5:
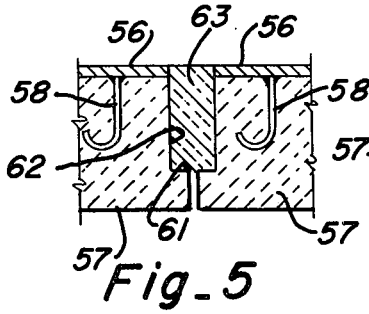
FIG. 5 is an enlarged sectional view through two adjoining liner members.
Figure 6:
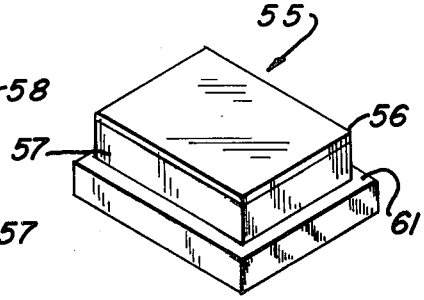
FIG. 6 is a perspective view of a single liner member.

As best seen in FIGS. 5 and 6, each refractory brick portion 57 has a top face secured to the backing plate, a bottom face and four vertical faces with adjacent vertical faces of each brick portion being at right angles to one another. A notch 61 is formed in the top face along each vertical face to provide a horizontal step so that when adjacent liner members are spaced apart from one another as shown in FIG. 5 there is formed a gap 62 that is wider at the top and inwardly stepped to be narrower at the bottom. The wider part of the gap is then filled with a filler or glazing composition 63 which may be of the aluminum silicate type such as KAO-WOOL or FIBREFAX. The gap being narrower at the bottom and wider at the top has been found highly effective in retaining the KAO-WOOL filler material even though there is a substantial vibration during the use thereof. The side frames 41 are shown as lined with a similar refractory brick portion 65 and the front and rear frames are lined with a refractory brick portion 66 so that the entire hood is lined with a refractory liner that serves to radiate heat toward the surface being heated. These refractory brick portions 65 and 66 in the side and front and rear wall portions are shown as partially retained by the inturned legs of a lower angle member 49 in the sides and a inturned leg in the lower angle member 67 in the front and rear. As best seen in FIG. 4, the front wall portions 38 are further provided with a plurality of laterally spaced burner ports 68 defined by tubular metal casings 69 inside surrounded by the refractory 66.

Figure 3:
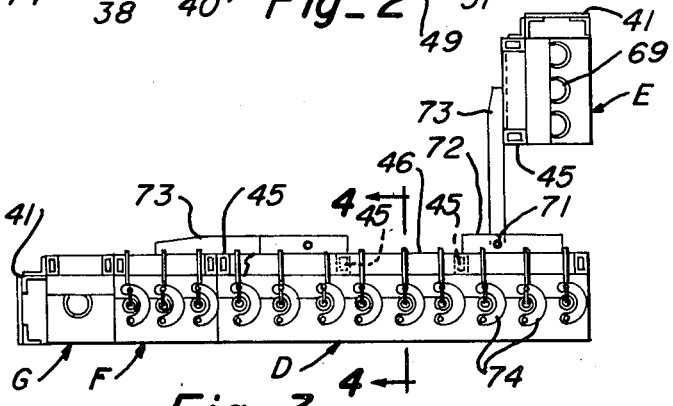
FIG. 3 is a front elevation view of FIG. 2 with a movable section of the hood and burner assembly swung up to a transport position and a side extension section mounted on the opposite side section.

The hood and burner assembly A shown is made in separate sections herein referred to as a main section D and a pair of oppositely disposed upswinging side sections E and F that move between an upper raised position for travel or non-use and a lower position for working with section F in the lower position and section E in the raised position in FIG. 3. A side extension section G is also shown as releasably mounted along the outer side of the movable section F in FIG. 3 with the side wall portion 41 then being mounted outside of the extension G by a plurality of bolt fasteners 52. The burners are not shown on sections E and G to expose the burner ports 68 therein but is is understood these sections normally have a burner for each burner port 68. In the sectional construction shown, the hood portion of main section D has a longitudinal member 45 along each side and two inner longitudinal members 45 as well as front and rear and intermediate cross members 46. Each of the hood portions of upswinging side sections E and F have to top framework with an outer longitudinal member 45 and an inner longitudinal member 45, a front end cross member 46, a rear end cross member 46 and a plurality of intermediate cross members 46.

The pivotal arrangement for each upswinging side section E and F is the same for each section and is provided by a pivot member 71 at a front position and at a rear position. Each support for each pivot member 71 is provided by a transverse plate 72 secured to a cross member 46 supporting the pivot member together with a swinging pivot arm 73 that connects at one end to the pivot member 71 and is affixed at its free swinging end to a cross bar 46 on the associated movable section. Each pivot member 71 is located above the top frame of that section and the swing for the movable section then is to a side by side position flush and in the same horizontal plane as that of the main section D so that it forms a side extension.

One preferred manner of swinging either of the side sections E and F to a raised upper position is to use a pulley and cable arrangement associated with upper frame structure shown about the fuel tank 24. The cable being attached to the side section and pulled on to raise the side section using the mechanical advantage of a pulley or block and tackle arrangement.

Finally, the side section extension G has a construction similar to that of the main and side sections. The outer support frame has two longitudinal members 45 and a front, rear and a plurality of intermediate cross members 46. The side extension G is releasably fastened by fasteners 52 as illustrated in FIG. 7. The main section D shown has nine burner ports or openings 68 and each movable section E and F has three burner ports or openings 68 and the extension G has one burner port 68. In a preferred embodiment the combined widths of sections D, E and F will be about 12 feet and the added side extension adds about 2 feet to the width.

A plurality of burners designated 74 are mounted at laterally spaced intervals on the front wall portion 38, with one burner 74 for each port. Each burner 74 directs a flame into the combustion chamber 42. Each burner 74 shown in more detail in FIG. 4 has an inlet line 75 into which the fuel is delivered and each is shown as mounted in a depending position by means of a bracket 76 which mounts on a forward projection 77 attached to the upper frame of the hood by bolts 78. The burner preferably burns a liquid fuel such as propane that expands and vaporizes and projects a flame into the inside of the combustion chamber 42 during the operation thereof. The details of the burner construction and the operation are described fully in U.S. Pat. No. 3,840,321.

The scarifying assembly B shown in general comprises an overhanging support frame 81 that carries an arrangement of depending curved leaf springs 82 having scarifying heads 83 secured at the lower ends thereof with surface engaging scarifying elements 84 that arc resiliently urged by the supported leaf springs 83 downwardly into a surface being worked to scrape, break up and distribute the surface material. In the arrangement shown, there is a front row of leaf springs and associated scarifying heads and a rear row of leaf springs and associated scarifying heads with each row arranged across or laterally of the support frame 81. The scarifying elements 84 of the front row preferably are slightly offset from the scarifying elements 84 of the rear row to engage surface areas between the front row of scarifying elements for a smoother, less ridged result.

The scarifying assembly B shown is made in three separate sections for ease of manufacture, a reduction in width for transport, if necessary, and to adjust in width for different road beds or the like asphaltic surfaces. These sections are a main section J that is in a central location on the trailer and a right side section K and a left side section L, the side sections being of a similar construction and each pivotally connected to the main section in a similar manner to pivot between a raised position and a lowered working position as described more fully hereinafter.

The overhanging support frame 81 for the entire scarifying assembly B shown is generally box-shaped and in its entirety has a box-shaped, open outer frame with an outer front support 86, opposed outer side supports 87 and 88, an an outer rear support 89 together with inner front lateral support 91 that carries the front row of leaf springs and an inner rear lateral support 92 that carries the rear row of leaf springs. The inner supports 91 and 92 are located inside the outer frame parallel to the front support and rear supports and there is further provided a plurality of intermediate, laterally spaced, longitudinal supports 93 along the inside of support frame 81.

With the preferred sectional construction shown, the overhanging support frame is constructed as a main frame section, a right side frame section, and a left side frame section which are of a similar construction. Referring specifically to the side frames of sections K and L, each have a front tubular member 95, opposed side tubular members 96 and 97 and a rear tubular member 98 connected at the ends in a box shape. These frame members are preferably of a metal tubing having a rectangular transverse cross section and welded at the ends. In a like manner the main frame section J has a front tubular member 101, opposed side members 102 and 103 and a rear member 104 connected at the ends in a box shape.

The inside lateral support 91 for the front row of leaf springs in each side section K and L is in the form of a tubular shaft section 106 mounted at each end in bushings 107 in side members 96 and 97 to rotate therein. An inner longitudinal support 93 is connected midway between side members 96 and 97 through which the tubular shaft 106 extends for added support thereof. Similarly, the inside support for the rear row of leaf springs in each side section is a tubular shaft section 106 mounted in bushings 107 in side members 96 and 97.

The inside support for the front row of leaf springs and the rear row of leaf springs in the main section J is similar to that of the side sections. This support includes a plurality of the tubular shaft sections 106 arranged end to end and in bushings 107 in the side tubular members 102 and 103 and bushing 108 in intermediate supports 93. The frame of the main section is shown to have a length of tubing 109 which carries bushings 107 for added strength and support.

Each leaf spring 82 is curved along its length to be generally C-shaped in profile and each spring 82 has a curved semi-circular end portion 111 that extends around the tubular shaft section 106 and is shown affixed thereto by a bolt fastener 112. Each of the tubular shaft sections 106 in the front row are held against rotation by a turnbuckle assembly 113 associated with each front tubular section 106 and an adjustable shaft assembly 114 associated with each rear tubular section 106. Each turnbuckle assembly 113 and shaft assembly 114 is affixed at one end to the associated shaft section end to the opposite end to a rear tubular member so that the angular position of each set of leaf springs associated with a tubular section is altered by alternating the setting of the threaded shaft of the associated assembly 113 or 114.

The scarifying heads 83 are of two different sizes or lengths designated with the suffix L used to designate for a longer length part and the suffix S for the shorter length part. The longer scarifying heads 83L and shorter scarifying heads 83S are arranged in a row and alternate between short and long across the apparatus. There are two leaf springs 82 attached to the shorter scarifying head 83S and three leaf springs attached to the longer scarifying heads 83L.

Each scarifying head 83 has an angle member 116 with a rearwardly projecting leg and an upstanding leg, the rearwardly projecting leg having a series of holes 117 arranged in a staggered or zig-zag pattern along the leg. The holes are of a size to slidably receive a scarifying element 84 which in the form shown is a conventional bolt with a head. The angle members 116 are of alternating longer and shorter lengths, designated 116L and 116S, respectively. The longer length angle member 116L has 11 holes 117 to support 11 scarifying elements 84 and the shorter length angle member 116S has seven holes to support seven scarifying elements 84. The scarifying elements on each head are removably held in place by an upper angle member 118 with a rearwardly projecting lower leg resting on the tops of the heads of the scarifying elements 84 and an upstanding leg through which a fastener 119 extends. Again the angle members are arranged with alternating longer and shorter lengths corresponding to the length of members 116L and 116S. Fastener 119 extends also through the upstanding leg of the angle member 116 and the lower end of the leaf springs 81 to hold each scarifying head together as an assembly.

In this way the scarifying elements 84 are arranged in laterally alternating larger and smaller groups with each group resiliently urged by associated leaf springs 82 and over head support structure 81 into the surface being raked. As shown, there are three leaf springs for the longer scarifying heads 83L and two leaf springs for the shorter scarifying heads 83S.

The mounting for the side sections K and L on main section J is facilitated by the provision of a pair of top cooperating upstanding lugs 121 and 122, lug 121 being affixed to the top of the main section J frame and the other lug 122 being affixed to the top of the frame of one of the side sections K or L. Lugs 121 and 122 have alined holes at an elevated position above the frame and receive a pivot pin 123 usually in the form of a removable bolt. A pair of these top lugs 121 and 122 are shown as provided at both the front and the rear of the support frame 81. There is further provided a pair of co-pending depending bottom lugs 124 and 125, one being affixed to the bottom of the frame of main section J and one being affixed to the bottom of the frame of one of the side sections K or L with alined holes in the lugs that receive a pivot pin 126. Again a pair of the lugs 124 and 125 are provided at both the front and rear of the frame. In practice when in the down position shown, the pins 123 are in position, but to pivot one of the side sections up, pin or bolt 126 has to be removed.

Vertical adjustment of the support frame 81 relative to the vehicle is provided by having angle members 127 at the connecting ends with three holes at vertically spaced intervals with one receiving a bolt and nut 129 connecting the support frame to support 31 and angle members 128 with three holes at vertically spaced intervals with one receiving a bolt and nut 130 connecting support 31 to frame 28 as best seen in FIGS. 8 and 9.

Figure 12:
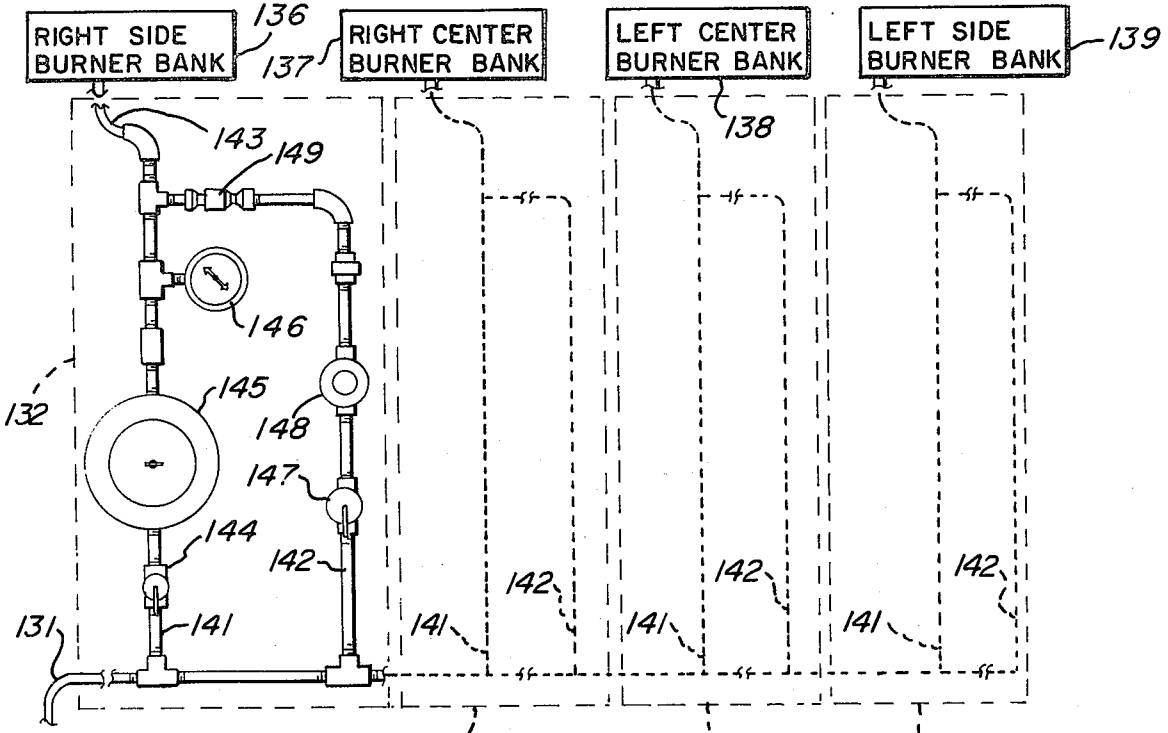
FIG. 12 is a fragmentary generally diagrammatic side elevation view of the control system for regulating the fuel from the fuel tank to the burners.
Figure 14:
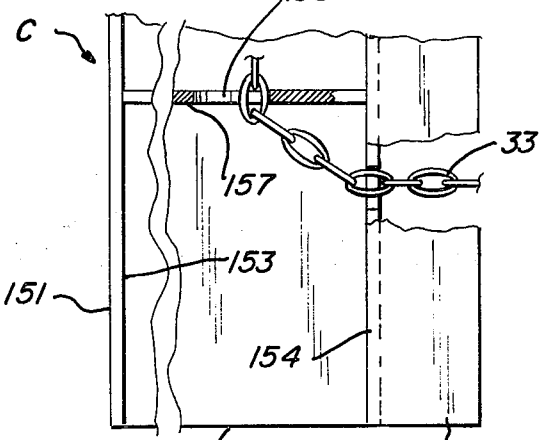
FIG. 14 is a top plan view of an end portion of the leveling device of FIG. 13.
Figure 13:
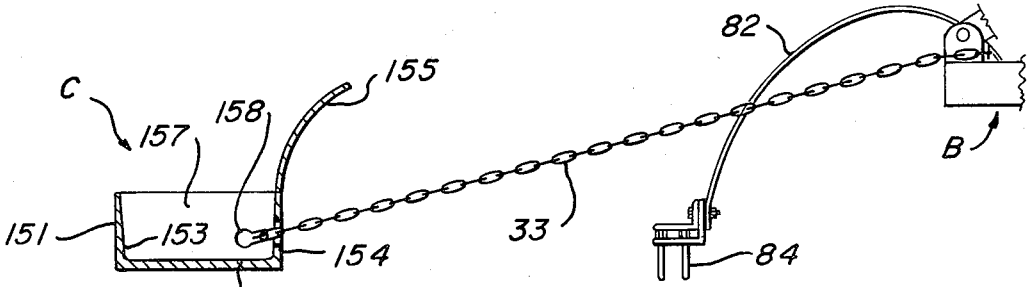
FIG. 13 is an end elevation view of the leveling device and its attachment to the frame of the scarifier assembly shown in FIG. 1.

The fuel from the fuel tank 24 is delivered to the burners by gravity flow through a supply line 131. The control for the fuel from the fuel tank to the burners is regulated by a control system illustrated diagrammatically in FIG. 12. In FIG. 12 there is shown the supply line 131 that comes by gravity flow from the fuel tank and delivers fuel to four similar control circuits arranged in parallel with each contained within a dashed block designated 132, 133, 134 and 135. Each circuit regulates the fuel to a bank or group of the fuel burners represented in block form in FIG. 13 as right-side burner bank 136 and right-center burner bank 137, left-center burner bank 138 and left-side burner bank 139. The number of burners on the left and right side burner banks depends on how many side extensions, if any, are added. For the hood shown in FIG. 3, there are four or five burners in the center banks 137 and 138 and four in the right side bank 136 and three in the left side bank 139.

Each of the four control circuits for the four banks is the same so that only one is illustrated in detail in block 132. This control circuit comprises a main flow line 141 and an auxiliary or pilot flow line 142, lines 141 and 142 being arranged parallel to one another each receiving fuel from the common input line 131 with the outlet of block 132 being coupled to burner bank 136 by flow line 143. The purpose of the main flow line 141 is to deliver fuel during normal operation and the pilot line 142 is to deliver fuel at a reduced rate and pressure during start up or transport operations. The main flow line 141 has a normally closed on-off valve 144, a pressure regulator valve 145 and a pressure indicator 146. The pilot line 142 has an on-off needle valve 147, a pressure regulator valve 148 and a flutter valve 149.

During start-up, valve 144 is closed and valve 147 is set to provide the desired pressure through line 142. The burners are ignited and they heat up to a point necessary to convert the liquid fuel to a gaseous state. After warm-up valve 144 is opened and full fuel is delivered to the burners. Valve 149 permits flow in only one direction and prevents backflow through the auxiliary line 142. With this control arrangement with parallel circuits being delivered fuel from a common line, selected burners and thereby only a selected part of the hood may be heated, usually depending on the width of the surface being worked.

The leveling device C is disposed in a trailing position being the scarifying assembly B. As shown leveling device C is comprised of an elongated channel member 151 with a flat bottom or web portion 152 and a pair of opposed upright side leg portions 153 and 154. A curved moldboard 155 extends upwardly from front leg 154 to push loosened surface material to the side. A plate 157 is provided in the channel members inset from each end of the channel member. Each plate 157 is provided with a keyhole-shaped chain hole 158 through which the pulling chain 33 is inserted. The head of the pulling chain 33 is releasably attached to plate 157 and extends forwardly via a hole in the side 154 from each end and attaches to the frame of the scarifier assembly. The purpose or function of this leveling device is to level the material after it has been broken up and distributed by assembly B. The length of the chain 33 can be varied so that the channel member 151 has one end ahead of the other to place it on an incline or at an angle to a true transverse or normal relation to the direction of travel thereof. An alternative manner of drawing the leveling device is to provide eyebolts on the front side of portion 154 inset from the ends of channel member 157 and have the keyhole-shaped chain holes in the frame of the scarifying assembly B to facilitate the adjustment of the length of the chain 33 on each side thereof.

OPERATION

In a full sequence of operation, the necessary sections of the hood and burner assembly A and the scarifying assembly B are moved to the lowered position depending on the width of the surface being worked. The height of the hood relation to the surface may be raised or lowered by manipulating selected levers 23 to actuate cylinders 21 and 22. The height of the scarifying assembly B may be adjusted by manipulating selected levers 23 to actuate cylinders 29 and further adjustments may be made by adjusting turnbuckles 32, assemblies 113 and 114 and bolts 129 and 130 as required.

During start up of the burners each valve 144 is closed and only a portion of full fuel is delivered to each burner. Once the fuel begins to vaporize, selected valves 144 are opened. The burners direct a flame into the combustion chamber which heats the liner and the liner in turn radiates heat toward the asphaltic surface that it overlies. The heat radiated may be as high as 2400° F and a major portion is in the infrared region of the spectrum to penetrate the asphaltic pavement. The scarifying assembly B then breaks up, scrapes and distributes the loosened material and finally the leveling device C levels or smooths the loosened material.

Although the present invention has been described with a certain degree of particularity, it is understood that the present disclosure has been made by way of example and that changes in details of structure may be made without departing from the spirit thereof.

What is claimed is:

1. In a surface treating apparatus, the combination comprising:

support frame means adapted to be moved over a surface to be worked;

a hood and burner assembly including a hood forming a combustion chamber open at the bottom and burners mounted on the hood adapted to direct heat into the combustion chamber, said hood being supported by said support frame means in an overlying relation and spaced from a surface to be heated;

a scarifying assembly supported by said support frame means in a trailing position behind said hood, said scarifying assembly including at least one row of depending scarifying elements, said row of scarifying elements arranged at laterally spaced intervals, each said scarifying element being in the form of a rigid straight slender rod, said row of scarifying elements being arranged at approximately equally spaced intervals in a zig-zag arrangement laterally of said support frame, said scarifying elements being resiliently urged into the heated surface for breaking up and distributing the material forming the heated surface; and leveling means drawn behind said scarifying assembly for leveling the broken up surface material.

2. In a surface treating apparatus as set forth in claim 1 wherein said scarifying elements are arranged in laterally alternating larger and smaller groups, each of said groups being independently resiliently urged toward the surface to adjust for surface irregularities, said scarifying elements being arranged in a front row and a back row, said front row being offset from said back row to engage the surface areas between said front row of scarifying elements.

3. In a surface treating apparatus as set forth in claim 1 wherein each said group of scarifying elements are resiliently urged by means of at least one curved leaf spring supported at an upper end by said upper support frame means.

4. In surface treating apparatus as set forth in claim 3 wherein said leaf springs are generally C-shaped in profile and have a curved end portion supported in a lateral support section of the support frame means for each group of scarifying elements, each said lateral support section being arranged for rotation, and adjustable means to set the angular position of each of said lateral support sections to adjust the position of said scarifying elements.

5. In a surface scarifying apparatus as set forth in claim 1 wherein each of said scarifying elements are mounted on a scarifying head including a support plate in the form of a leg portion of an angle member having a plurality of holes found thereon, each hole being sized to slidably receive a scarifying element in the form of a headed bolt.

6. In a surface scarifying apparatus as set forth in claim 5 wherein each scarifying head has a second angle member releasably holding the scarifying elements in the holes in the plates.

7. In surface treating apparatus as set forth in claim 1 wherein said leveling means includes a channel member with a flat bottom portion movable over the surface being worked, a moldboard portion extending up from the front of the channel member to deflect the surface material to the side and chain means of adjustable length secured adjacent the opposite ends of said channel member and to said scarifying assembly whereby said channel member is drawn behind said scarifying assembly.

8. In surface treating apparatus as set forth in claim 7 wherein said channel member has a plate inset from each ends thereof, each plate having a keyhole adapted to receive a selected link of said chain means.

9. In surface treating apparatus as set forth in claim 1 wherein said support frame means includes a trailer-type vehicle and including motive power means between said frame of the trailer-type vehicle and said motive power means to raise and lower said scarifying assembly in relation to the surface being worked.

10. In a surface treating apparatus, the combination comprising:

support frame means adapted to be moved over a surface to be worked;

a hood and burner assembly including a hood forming a combustion chamber open at the bottom and burners mounted on the hood adapted to direct heat into the combustion chamber, said hood being supported by said support frame means in an overlying relation and spaced from a surface to be heated, said hood having an inner liner of a refractory material forming a combustion chamber adapted to radiate heat generated by the burners to the surface over which the hood is moved, the top of said liner being made up of a plurality of liner members stepped along each side to provide a joint gap between adjacent liner members that is wider at the top and narrower at the bottom and inwardly stepped to receive and retain a gap filler material, there being a space between adjacent surfaces of adjacent liner members at each joint gap so said adjacent surfaces do not touch one another;

a scarifying assembly supported by said support frame means in a trailing position behind said hood, said scarifying assembly including at least one row of depending scarifying elements, said row of scarifying elements arranged at laterally spaced intervals and being resiliently urged into the heated surface for breaking up the material forming the heated surface; and leveling means drawn behind said scarifying assembly for leveling the broken up surface material.

11. In a surface treating apparatus as set forth in claim 10 wherein each said liner member is comprised of a metal backing plate having a plurality of J-hooks fastened thereto and a refractory material molded over said J-hooks on one face of said plate.

12. In a surface treating apparatus as set forth in claim 10 wherein said inner liner has a roof surface that tapers downwardly from the leading end to the trailing end to progressively decrease the volume of said combustion chamber along a substantially straight line from the leading end to the trailing end thereof for a more uniform heating effect.

13. In a surface treating apparatus, the combination comprising:

support frame means adapted to be moved over a surface to be worked;

a hood and burner assembly including a hood forming a combustion chamber open at the bottom and burners mounted on the hood adapted to direct heat into the combustion chamber, said hood being supported by said support frame means in an overlying relation and spaced from a surface to be heated, said hood having a main section and a pair of opposed side sections separate from said main section, said side section being pivotally connected to said main sedtion to swing between a lower working position wherein each form a lateral extension of the main section and a raised transport position disposed above and substantially within the lateral extension of the main section and a raised transport position disposed above and substantially within the lateral extremity of the main section;

a scarifying assembly supported by said support frame means in a trailing position behind said hood, said scarifying assembly including at least one row of depending scarifying elements, said row of scarifying elements arranged at laterally spaced intervals and being resiliently urged into the heated surface for breaking up the material forming the heated surface; and leveling means drawn behind said scarifying assembly for leveling the broken up surface material.

14. In a surface treating apparatus as set forth in claim 13 including at least one side extension of said hood removably mounted on one of said side sections to increase the width of said hood.

15. In a surface treating apparatus as set forth in claim 13 including fuel control means for regulating fuel to said burners, said fuel control means having a separate control circuit for the burners for said main section and each of said side sections, each said control circuit including a main flow line for delivering a selected quantity of fuel during normal operation and a pilot flow line for delivering a lesser quantity of fuel during start-up and transport operations.

16. In a surface treating apparatus as set forth in claim 15 wherein each of said main flow lines have an on-off control valve, a pressure regulator valve and a pressure gauge and each of said pilot flow lines has an on-off control valve, a pressure regulator valve and a flutter valve arranged to inhibit backflow therethrough.

17. In surface treating apparatus as set forth in claim 13 wherein said support frame means includes a trailer-type vehicle and including motive power means between a frame of said trailer-type vehicle and said hood to raise and lower the hood in relation to the surface being heated.

18. In a surface treating apparatus, the combination comprising:

support frame means adapted to be moved over a surface to be worked;

a hood and burner assembly including a hood forming a combustion chamber open at the bottom and burners mounted on the hood adapted to direct heat into the combustion chamber, said hood being supported by said support frame means in an overlying relation and spaced from a surface to be heated;

a scarifying assembly supported by said support frame means in a trailing position behind said hood, said scarifying assembly including at least one row of depending scarifying elements, said row of scarifying elements arranged at laterally spaced intervals and being resiliently urged into the heated surface for breaking up the material forming the heated surface, said scarifying assembly having a main section and a movable side section on each side of the main section and separate therefrom adapted to swing between a raised position above the main section and a lowered position whereon each side section forms a side extension of said main section; and leveling means drawn behind said scarifying assembly for leveling the broken up surface material.

19. In a surface treating apparatus, the combination comprising:

a support means; and scarifying means carried by said support means including a row of depending scarifying elements arranged at laterally spaced intervals, each said scarifying elements being in the form of a rigid straight slender rod, said row of scarifying elements being arranged at approximately equally spaced intervals in a zigzag arrangement laterally of said support frame, said scarifying elements being arranged in laterally alternating larger and smaller groups, each of said groups being independently resiliently urged by said support means into a surface being worked to adjust for surface irregularities.

20. In a surface treating apparatus, the combination comprising:

a support frame; and a hood and burner assembly including a hood and burners mounted on the hood adapted to direct heat into the hood, said hood being supported by said support frame and overlying and spaced from a surface to be heated, said hood having a liner of refractory material forming a combustion chamber open at the bottom adapted to radiate heat generated by said burners to the surface over which the hood is moved, the top of said liner being made up of a plurality of individual liner members stepped along each side to provide a joint gap between adjacent liner members that is wider at the top and narrower at the bottom and inwardly stepped to retain a glazing composition, there being a space between adjacent surfaces of adjacent liner members at each joint gap so said adjacent surfaces do not touch one another, the inner liner having a roof surface that tapers downwardly from the leading end to the trailing end to progressively decrease the volume of said combustion chamber, said taper being along a substantially straight line from the leading end to the trailing end thereof for a more uniform heating effect.

21. In a surface treating apparatus, the combination comprising a hood and burner assembly having a hood with a top wall portion, front wall portion, a pair of opposed spaced side walls, a rear wall that forms an inner combustion chamber open at the bottom adapted for overlying and being spaced from a surface to be heated, a roof of said top wall being tapered downwardly toward the rear wall along the inside so that the combustion chamber gradually decreases in volume toward the rear wall for uniformity of heating of the surface, said front wall having a plurality of laterally spaced burner ports, said hood having an outer skeletal support frame and inner liner, said outer support frame having a top frame portion including laterally spaced, longitudinal members and spaced cross members connected at the end with the longitudinal members, side frame portions including an upper and a lower longitudinal member, front frame portions including upper and lower lateral members and spaced upright connecting members, rear frame portions including upper and lower lateral members and spaced upright connecting members, said inner liner including a plurality of adjacent, heat radiating liner members each said liner member having a backing plate a refractory position on one face of said backing plate, said refractory position having a top face, a bottom face, four vertical faces with each adjacent vertical faces at right angles to one another, and a notch formed in a top face along each vertical face forming a stepped face adjacent liner members having facing notches forming a gap that is wider at the top and inwardly stepped to be narrower at the bottom, and the wider portion of said gaps being filled with a glazing composition a plurality of burners mounted at the front wall portion of said hood, each burner adjacent an associated burner port for directing a flame into the inside of the combustion chamber to heat the liner and reflect heat in the infrared region onto the surface below the combustion chamber, a main section, a pair of opposed side section pivotally connected to the main section to swing between a lower working position wherein they form a lateral extension of the main section and a raised transport position disposed above and substantially within the lateral extremity of the main section.

22. In surface treating apparatus as set forth in claim 21 including a supporting vehicle frame for said hood and burner assembly, double-acting hydraulic cylinder means between said vehicle frame and said outer support frame to raise and lower said hood.

23. In a surface treating apparatus, the combination comprising:

a support frame including an outer open box-shaped frame with a front portion, a pair of opposed side portions, and a rear portion inner front and rear lateral supports connected inside said frame inner intermediate longitudinal supports connected inside said outer frame with bushings to support the lateral supports for rotation in said bushings said support frame having a main section and a pair of opposed side sections separate from said main section, said side sections being pivotally connected to the main section to swing between a working position when they form a lateral extension of the main section and a raised position a front group of curved, laterally spaced leaf springs arranged parallel to one another, each leaf spring connected at one end to said front inner lateral support, a rear group of curved, laterally spaced leaf springs arranged parallel to one another, each leaf spring connected at one end to said rear inner lateral support, a front row of support plates supported by the free ends of said front group of leaf springs, each of said support plates being in the form of a lower rearwardly projecting leg of an angle member also having an upstanding leg portion, a rear row of support plates supported by the free ends of said rear group of leaf springs, each of said support plates being in the form of a lower leg of a rearwardly projecting angle member also having an upstanding leg portion, said rear support plates being arranged in alternating longer and shorter lengths, a front row of front scarifying elements removably mounted in holes in said front row of said support plates, said front scarifying elements being arranged in a zig-zag pattern along said support plate, there being fewer holes and associated scarifying elements in the shorter length plates than the longer length plates to provide alternating larger and smaller groups of the scarifying elements; and a rear row of rear scarifying elements removably mounted in rear holes in said rear row of support plates, said rear scarifying elements being arranged in a zig-zag pattern along said support plate, there being fewer holes and associated scarifying elements in the shorter length plates than the longer length plate to provide alternating larger and smaller groups of the scarifying elements.

24. In surface treating apparatus as set forth in claim 23 including a vehicle frame and double-acting hydraulic cylinder between the vehicle frame and the support frame to selectively raise and lower said scarifying assembly.

* * * * *